United States Patent [19]

Bérubé et al.

[11] Patent Number: 4,633,782

[45] Date of Patent: Jan. 6, 1987

[54] CENTERING ADAPTOR FOR AN ANTI-ARMOUR KINETIC ENERGY PENETRATOR

[75] Inventors: Gilles Bérubé; Raymond Langlois, both of Loretteville, Canada

[73] Assignee: Minister of National Defence of Her Majesty's Canadian Government, Canada

[21] Appl. No.: 682,911

[22] Filed: Dec. 18, 1984

[30] Foreign Application Priority Data

Apr. 19, 1984 [CA] Canada ..... 452546

[51] Int. Cl.[4] ..... F42B 11/06

[52] U.S. Cl. ..... 102/518; 102/514; 102/529

[58] Field of Search ..... 102/501, 514–519, 102/529

[56] References Cited

U.S. PATENT DOCUMENTS 4,108,073 8/1978 Davis ..... 102/518
4,498,396 12/1985 Berube ..... 102/529

FOREIGN PATENT DOCUMENTS 586174 3/1947 United Kingdom ..... 102/518

*Primary Examiner*—Harold J. Tudor
*Attorney, Agent, or Firm*—Stevens, Davis, Miller & Mosher

[57] ABSTRACT

A conversion assembly for converting a practice warhead (10) into an armour penetrating warhead (30) is disclosed. The practice warhead (10) is the type having a plastic shell (11) with sockets (20,22) at both ends for receiving a metal ballast, such as a steel rod (24). The conversion assembly consists of a penetrator rod (32) of heavy metal with an outside diameter ($D_R$) substantially less than the inside diameter of the sockets (20,22) in the shell (11) and two adaptor cups (34) of elastomeric material that are stretched over the ends of the penetrator rod (32) and then fitted into the sockets in the shell. The adaptor cups (34) each have, in the relaxed state, a substantially uniform peripheral wall thickness, an inner diameter slightly less than the outside diameter ($D_R$) of the penetrator rod (32) and an outside diameter slightly less than the inside diameter of the sockets (20,22) in the shell (11). In preferred embodiments, the adaptor cup (34) has a boss (40) on its end wall or base to provide a flexible cushion to absorb differential expansion of the penetrator rod (32) and the shell (11). It is further preferred that the elastomeric material be relatively hard, e.g. a Shore A hardness of 70.

15 Claims, 6 Drawing Figures

CENTERING ADAPTOR FOR AN ANTI-ARMOUR KINETIC ENERGY PENETRATOR

The present invention relates to the conversion of a practice warhead into an armour penetrating warhead.

In Canadian Pat. No. 1,109,730, issued Sept. 29, 1981 naming Gilles Berube as inventor, there is described a practice warhead for an air to surface rocket. The warhead has a hollow plastic shell and a steel rod inside the shell as a ballast so that the practice shell simulates the characteristics of a real warhead. It is proposed in that patent that the warhead could be used as a kinetic energy penetrator by replacing the steel rod with a rod of a heavy metal such as tungsten or depleted uranium. However, two of the practical characteristics of a kinetic energy penetrator that determine its effectiveness are its length to diameter ratio (L/d) and its mass. A kinetic energy penetrator of tungsten or depleted uranium having the same dimensions as the steel ballast rod of the practice warhead would possess characteristics in terms of its mass and (L/d) ratio which are far from optimum. To provide an effective penetrator, the diameter of the tungsten or depleted uranium rod must be reduced in the order of 35% while retaining the same length. This yields a length to diameter ratio that is more acceptable and brings the weight of the projectile into the range tolerance for the practice warhead, thus allowing the use of the same firing table for the penetrator and the practice warheads.

Reduction in the rod diameter brings with it other problems. The steel ballast rod is dimensioned to fit snugly into sockets at the ends of the shell, thus ensuring centering of the ballast. With a smaller diameter penetrator rod, some means must be provided for centering the rod in the shell. It is to be noted that improper centering of the rod will unbalance the projectile and render it unstable.

The present invention relates to a simple and relatively inexpensive conversion assembly including adapters that provide the necessary centering of the penetrator rod without requiring expensive close tolerance manufacturing or fitting operations.

According to the present invention there is provided a conversion assembly for converting a practice warhead to an armour penetrating warhead, the practice warhead having a shell with sockets at both ends for receiving a metal ballast rod, the conversion assembly comprising:

a penetrator rod with an outside diameter substantially less than the inside diameter of the sockets in the shell; and two adapters, each being in the form of a cup of elastomeric material, each adapter cup having, in a relaxed state, a substantially uniform side wall thickness, an inner diameter slightly less than the outside diameter of the penetrator rod and an outside diameter slightly less than the inside diameter of the sockets in the shell, the adapter cups in use, being in a stretched condition and extending over respective ends of the penetrator rod.

Thus, rather than manufacturing the adapter of a rigid material with close tolerances to the final dimensions required for assembly, the adapter cup is made of resilient elastomeric material with close control only of the wall thickness. Because the inside diameter of the adapter cup is less than the outside diameter of the penetrator rod, the adapter cup is stretched when assembled to the rod. If the quantity of material used for each adapter cup and the wall thickness of same are closely controlled, the outside diameter of the adapter cup will be constant after assembly. In practice, there is a tolerance in the diameter of the penetrator rod and this tolerance is reproduced in the outside diameter of the adapter cup after assembly. A small variation in the thickness of the adapter cup wall may also be expected. Nonetheless, the technique permits a considerable reduction in the variation of the outside diameter of the adapter cut and thus the potential for imbalance in the projectile in use.

In preferred embodiments of the invention, the elastomeric material of the adapter cup is relatively hard, for example with a Shore A hardness of 70. This provides assistance in reducing the dynamic unbalance of the projectile.

It is also preferred that the adapter cup have a boss on the inside surface of the base of the cup. The boss is readily compressed to accommodate thermal expansion, thus minimizing the generation of excessive stress in the plastic shell.

To allow the escape of air from within the adapter cup as it is installed on the penetrator rod, vent holes may be provided through the base (end wall) of the cup. Similarly, vent grooves may be on the outside side wall of the adapter cup from end to end to allow the escape of air from the sockets in the shell during assembly.

In the accompanying drawings, which illustrate a practice warhead and embodiments of the present invention:

Figure 1:
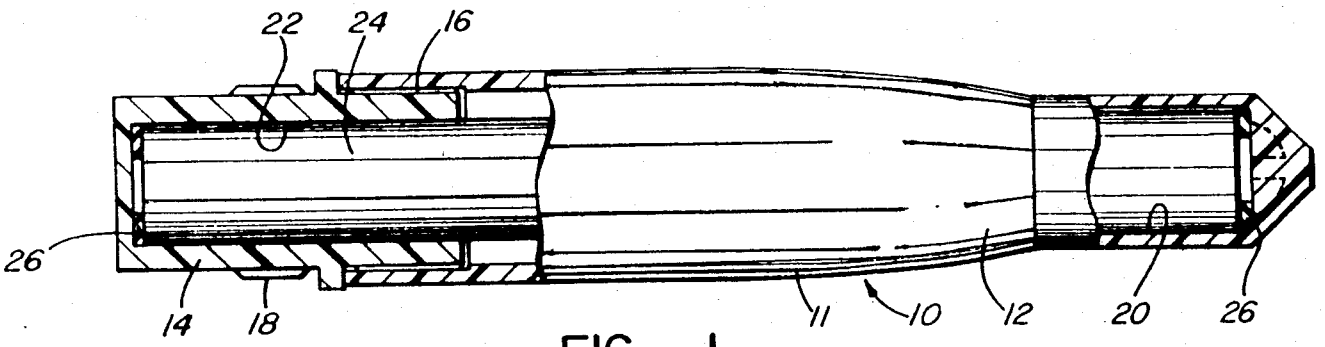
FIG. 1 is a side view, partially in section of a practice warhead, the section being in the plane 1—1 of FIG. 2A.

Turning to the accompanying drawings, FIG. 1 illustrates a practice warhead 10 essentially as described in the above-noted Berube Canadian Pat. No. 1,109,730. The warhead has a plastic shell 11 (typically a nylon/fibreglass composition e.g. 70%/w nylon and 30%/w fibreglass), the shell 11 including a forward nose section 12 and an aft coupling 14 which are connected to each other via screw threaded portion 16 to complete the shell. The coupling 14 is externally threaded at 18 so that it can be screwed onto the nose of the rocket motor. The nose section has a socket 20 of cylindrical shape at the front end. The coupling 14 defines a similar socket 22. The two sockets snugly accommodate a steel rod 24 that serves as a ballast for the practice warhead. Elastomer washers 26 are fitted at opposing ends of the rod 24 to accommodate differential thermal expansion of the rod and the shell.

Figure 2:
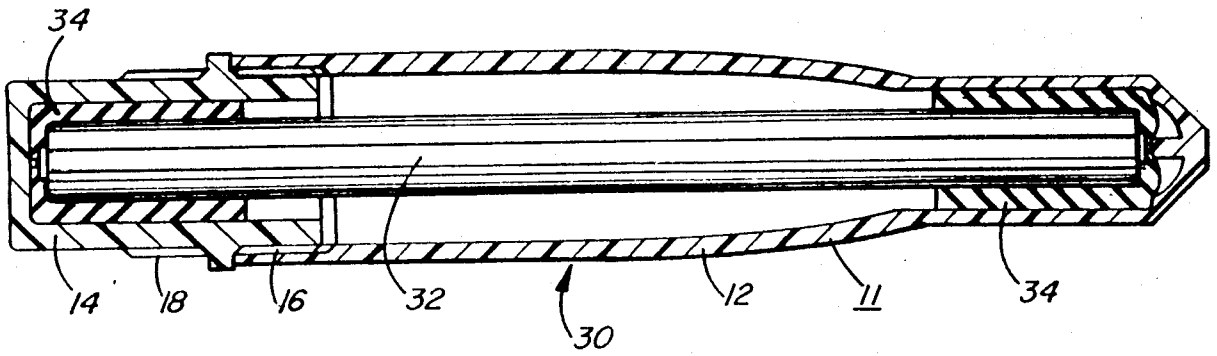
FIG. 2 is a longitudinal section of a penetrator warhead according to the present invention the section being in the plane 2—2 of FIG. 2A.
Figure 2A:
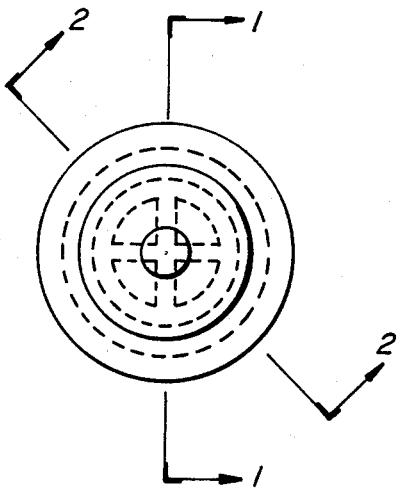
FIG. 2A is an end elevation view of the practice warhead of FIG. 1 and FIG. 2.

FIG. 2 illustrates the shell of FIG. 1, converted for use as a kinetic energy armour penetrating warhead 30 in accordance with a preferred form of the present invention. The warhead 30 includes the same shell components, that is, the nose 12 and coupling 14, but the ballast rod 24 has been removed and replaced with a heavy metal rod 32 of the same length as the ballast rod 24 but having a diameter $D_R$ which is considerably smaller (e.g.35% smaller) than the diameter of the above mentioned ballast rod 24. It therefore follows that the penetrator rod 32 diameter $D_R$ is substantially less than the inside diameter of the sockets 20, 22 at the ends of plastic shell 11. To center the penetrator rod 32 in the shell, it is equipped with an adapter cup 34 at both ends. Each adapter cup 34 snugly fits into an associated socket 20, 22 to ensure proper centering of the penetrator rod 32.

Figure 4:
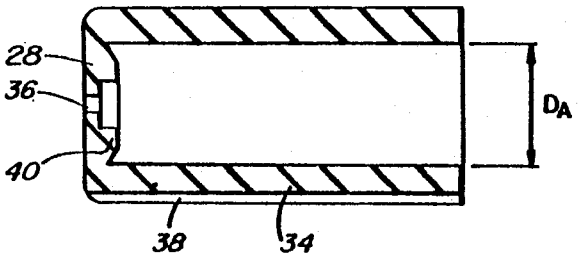
FIG. 4 is a section along line 4—4 of FIG. 3.
Figure 3:
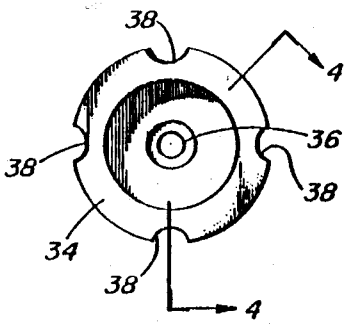
FIG. 3 is an end view of an adapter cup according to the present invention.

As illustrated in FIGS. 3 and 4, each adapter cup 34 has a cylindrical side wall of generally uniform thickness with the cup bottom being defined by a base or end wall 28. At the base of the adapter cup there is a vent hole 36 to allow the escape of air when the adapter cup is being placed on the penetrator rod 32. Vent grooves 38 extend the length of the adapter cup in the outside of the side wall to allow air to escape from the sockets 20 and 22 when the adapter cup is being fitted into the sockets.

The adapter cup 34 is of a relatively hard synthetic rubber material, preferably with a Shore A hardness of about 70. To accommodate tolerances and differential thermal expansion between the penetrator rod 32 and the shell 11, the adapter cup is equipped with a boss 40 on the inside of its base or end wall 28 which boss is more readily susceptible to deformation than a plain flat rubber base would be.

Figure 5:
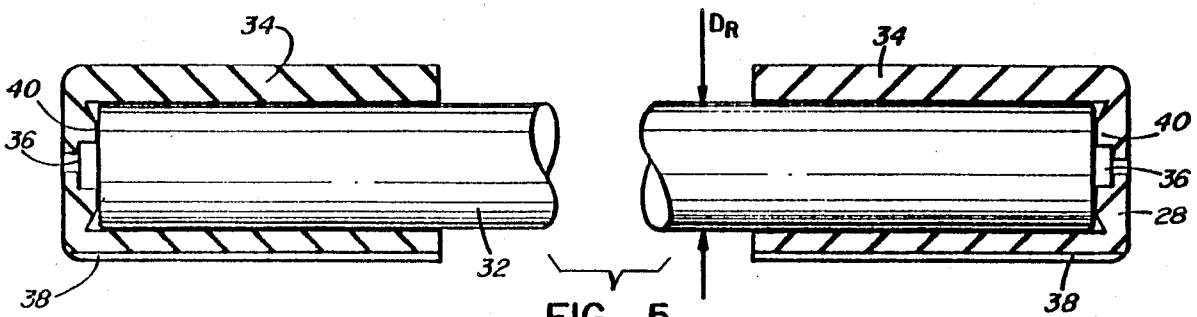
FIG. 5 is a side view, partially in section, of the penetrator rod and adapter cup assembly.

The inside diameter $D_A$ of the adapter cup is slightly smaller than the outside diameter $D_R$ (FIG. 5) of the penetrator rod 32. Consequently, when the adapter cup 34 is installed on the ends of the rod 32, the wall of each adapter cup is stretched. This ensures a good snug fit of the adapter cup over the rod ends and secure retention of the rod at the center of the shell 11, thereby eliminating imbalance problems.

The penetrator rod 32 may, as described in the above-noted Canadian Pat. No. 1,109,730, be of tungsten or depleted uranium. It may also be a tungsten alloy selected to provide sufficient mass at the desired (L/d) ratio as to bring the weight of the armour penetrating warhead into the range tolerance for the practice warhead as described previously.

We claim:

1. A conversion assembly for converting a practice warhead to an armour penetrating warhead, the practice warhead having a hollow plastic shell with sockets at opposing ends thereof for receiving a metal ballast, the shell being separable into two parts to allow the metal ballast to be placed within said shell, the conversion assembly comprising:

a penetrator rod replacement for the metal ballast, said rod having an outside diameter substantially less than the inside diameter of the sockets in the shell; and two adapters each being in the form of a cup made from elastomeric material, each adapter cup having, in a relaxed state, a substantially uniform side wall thickness, an inner diameter slightly less than the outside diameter of the penetrator rod and an outside diameter slightly less than the inside diameter of the sockets in the shell, the adapter cups, in use, being in a stretched condition and extending over respective ends of the penetrator rod and such cups also fitting snugly into respective said sockets when in use to positively center the penetrator rod in the hollow shell.

2. A conversion assembly according to claim 1, including a deformable boss on the base of the adapter cup, on the inside surface thereof, to accommodate differential expansion between the shell and penetrator rod.

3. A conversion assembly according to claim 1 including a vent hole through the base of the adapter cup.

4. A conversion assembly according to claim 1 including at least one vent groove in and extending along the exterior surface of the side wall of the adapter cup from end to end thereof.

5. A conversion assembly according to claim 4 including a plurality of said vent grooves extending along the outside wall of the cup from end to end.

6. A conversion assembly according to claim 2 including a vent hole through the base of the adapter cup and at least one vent groove extending in and along the exterior surface of the side wall of the adapter cup from end to end.

7. A conversion assembly according to claim 4 further including a plurality of vent grooves in and extending along the exterior surface of the side wall of the adapter cup from end to end thereof.

8. A conversion assembly according to claim 1 where the elastomeric material has a Shore A hardness of about 70.

9. A conversion assembly according to claim 1 wherein the penetrator rod is tungsten or a tungsten alloy.

10. A conversion assembly according to claim 1 wherein the penetrator rod is depleted uranium.

11. A converted armour penetrating warhead, comprising:

a hollow plastic shell with sockets at opposing ends thereof for receiving a metal ballast, the shell being separable into two parts to allow the metal ballast to be placed within said shell;

a penetrator rod replacement for the metal ballast, said rod having an outside diameter substantially less than the inside diameter of the sockets, said rod being located within said shell with opposing ends of said rod extending into said sockets;

two adapters each being in the form of a cup made from elastomeric material, each adapter cup having, in a relaxed state, a substantially uniform side wall thickness, an inner diameter slightly less than the outside diameter of the penetrator rod and an outside diameter slightly less than the inside diameter of the sockets in the shell, the adapter cups being in a stretched condition and snugly extending over respective ends of the penetrator rod and such cups also fitting snugly into respective said sockets to positively center the penetrator rod in the hollow shell.

12. A converted warhead according to claim 11, including a deformable boss on the base of the adapter cup, on the inside surface thereof, to accommodate differential expansion between the shell and penetrator rod.

13. A converted warhead according to claim 11, including a vent hole through the base of the adapter cup.

14. A converted warhead according to claim 13, including at least one vent groove in and extending along the exterior surface of the side wall of the adapter cup from end to end thereof.

15. A converted warhead according to claim 11 wherein the elastomeric material has a Shore A hardness of about 70 and the penetrator rod is of high density material such as tungsten or depleted uranium.

* * * * *